United States Patent [19]

Veling et al.

[11] Patent Number: 4,570,317

[45] Date of Patent: Feb. 18, 1986

[54] METHOD OF ATTACHING A TUBE TO A FIN

[75] Inventors: Thomas R. Veling, Dearborn; George C. Wiklund, Canton; Kwang H. Park, Grosse Ile, all of Mich.

[73] Assignee: Ford Motor Company, Dearborn, Mich.

[21] Appl. No.: 692,459

[22] Filed: Jan. 18, 1985

[51] Int. Cl.[4] ..... B21D 53/08

[52] U.S. Cl. ..... 29/157.3 A; 29/157.3 C; 29/523; 29/522 R; 403/277

[58] Field of Search ..... 29/157.3 R, 157.3 A, 29/157.3 AH, 157.3 B, 157.3 C, 157.3 H, 157.3 V, 157.4, 512, 523, 522 R; 165/151; 403/277, 280, 274

[56] References Cited

U.S. PATENT DOCUMENTS

| | | | |
|---|---|---|---|
| 2,488,627 | 11/1949 | Hisey | 165/151 X |
| 3,852,871 | 12/1974 | Read, Jr. | 29/523 X |
| 4,269,267 | 5/1981 | Labrande | 29/157.3 A X |
| 4,421,137 | 12/1983 | Nusbaumer et al. | 29/521 X |

FOREIGN PATENT DOCUMENTS

| | | | |
|---|---|---|---|
| 890119 | 1/1972 | Canada | 29/157.3 AH |
| 1110598 | 7/1961 | Fed. Rep. of Germany | 29/157.3 B |

*Primary Examiner*—Howard N. Goldberg
*Assistant Examiner*—John T. Burtch
*Attorney, Agent, or Firm*—William E. Johnson; Clifford L. Sadler

[57] ABSTRACT

This specification teaches a method of attaching a fluid conducting metal tube (12) a heat dissipating metal fin (14) that includes the following steps. A metal tube (12) is formed having a generally elliptical cross-section having first similarly curved surfaces (22—22) at opposite ends of a major axis thereof and second similarly curved surfaces (24—24) at opposite ends of a minor axis thereof. A heat dissipating metal fin (14) is formed. An elliptically shaped collar (20) is formed on the fin, this collar providing an opening through the fin and being at least about 1½ times the thickness of the metal forming the fin. The tube is fitted inside the opening of the fin so that areas of these two elements are juxtaposed. The tube is expanded along the major axis so as to bring the first similarly curved surfaces at opposite ends thereof into contact with portions of the collar in juxtaposition therewith. Expansion of the tube is continued along the major axis and initiated along the tube from opposite ends of the major axis toward the surfaces which were defined at opposite ends of the minor axis of the tube. In this manner, any juxtaposed area of the tube and the collar are subjected to an expansion process in which the tube is moved towards the collar, the two elements are brought into contact with one another, and then the two elements are expanded together. The expansion process is progressively terminated between the tube and collar from the major axis of the tube toward the minor axis thereof. The termination occurs in such juxtaposed areas as those areas reach a condition in which the tube is being deformed plastically but the collar is still being deformed elastically. In such a manner, excellent mechanical and thermal contact is made between the tube and the collar of the fin whereby excellent heat transfer may be carried out therebetween.

8 Claims, 9 Drawing Figures

METHOD OF ATTACHING A TUBE TO A FIN

TECHNICAL FIELD

This application is directed to a method of attaching a tube to a fin and is particularly concerned with a method of attaching a fluid conducting metal tube to a heat dissipating metal fin. Many similar connections are made in a single radiator structure in order to have a unique radiator construction.

BACKGROUND AND PRIOR ART STATEMENT

One present day known way of making radiators is a so-called mechanically assembled radiator. In such a mechanically assembled radiator, tubes having a round cross-section are expanded uniformly about their circumference into contact with a surface area of a heat dissipating metal fin encircling the same. This type of construction is well known in the art.

Other constructions for radiators include oval and elliptical cross-section tubes which are brazed to a heat dissipating metal fin. Such tube radiator configurations create a compact heat exchanger which is optimized with respect to cost and weight while minimizing the total radiator's volumetric displacement.

No one, to the best of our knowledge, has come up with a design for making a mechanically assembled, elliptical tube radiator. Uniform expansion of an elliptical tube into a heat dissipating fin does not work. The construction does not work because the expansion process results in poor tube contact with surrounding collars as well as splits in tubes and collars.

We have invented a new method of expanding an elliptical tube into contact with a heat dissipating metal fin which ensures excellent heat conducting contact as well as good mechanical contact therebetween.

No search was conducted on the subject matter of this specification in the U.S. Patent Office or in any other search facility. We are unaware of any prior art more relevant to the subject matter of this specification than that which was described above, namely, the expansion of circular cross-section tubes to form a mechanically assembled radiator.

DISCLOSURE OF INVENTION

This invention relates to a method of attaching a tube to a fin and, more particularly, to a method of attaching a fluid conducting metal tube to a heat dissipating metal fin. In particular, the method is directed to attachment of a fluid conducting elliptical cross-section tube to a heat dissipating metal fin. The method is used repeatedly to form a number of such attachments so that a radiator may be formed.

In accordance with the teachings of this specification, a method of attaching a fluid conducting metal tube to a heat dissipating metal fin has the following steps.

A metal tube is formed which has a generally elliptical cross-section. The elliptical cross-section of the tube is one in which similarly curved surfaces are located at opposite ends of a major axis thereof and second similarly curved surfaces are located at opposite ends of a minor axis thereof.

A heat dissipating metal fin is formed. An elliptically shaped collar is formed on the fin. The collar provides an opening through the fin and is at least about 1½ times the thickness of the metal forming the fin. The opening provided by the collar of the fin is of a size slightly larger than the elliptical cross-section of the tube.

The tube is fitted inside the opening of the collar of the fin. In this manner, areas of the tube and the collar are juxtaposed.

The tube is expanded along a major axis thereof so as to bring the first similarly curved surfaces at opposite ends of that axis into contact with portions of the collar in juxtaposition therewith.

Expansion along the major axis is continued and expansion of the tube from opposite ends of the major axis toward the surfaces which were defined at opposite ends of the minor axis of the tube are initiated. In this manner, any juxtaposed area of the tube and the collar are subjected to an expansion process in which the tube is moved towards the collar, the two elements are brought into contact with one another, and then the two elements are expanded together The tube and collar expansion process is progressively terminated from the major axis of the tube toward the minor axis thereof. The expansion is terminated as juxtaposed areas of the tube and the collar reach a condition in which the tube is being deformed plastically, but the collar is still being deformed elastically. In this manner, the tube retains its deformed position while the collar elastically grips the same and applies pressure thereto, whereby excellent thermal and mechanical contact is made between the two elements.

When this process is repeated a number of times, many tubes may be connected to many heat dissipating metal fins. In such a manner, a radiator construction can be built up. However, the process is an excellent one for joining any elliptical cross-section tube to a metal fin to construct any type of heat dissipating device.

In accordance with a preferred embodiment of this invention, the ratio of the length of the major axis to the length of the minor axis is above 3:1 and most preferably is above 3.7:1.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of specific embodiments when read in connection with the accompanying drawings, wherein like reference characters indicate like parts throughout the several figures, and in which:

FIGS. 7, 8 and 9 are enlarged schematic views showing the method of this invention in various steps as it expands a metal tube into contact with a metal fin.

BEST MODE AND INDUSTRIAL APPLICABILITY

The following description is what we consider to be a preferred embodiment of the method of our invention of attaching a fluid conducting metal tube to a heat dissipating metal fin. The following description also sets forth what we now contemplate to be the best mode of carrying out our method. The description, however, is not intended to be a limitation upon the broader principles of this method, and while preferred materials are used to illustrate the method in accordance with the requirements of the laws, it does not mean that other materials cannot be used with this method.

Figure 1:
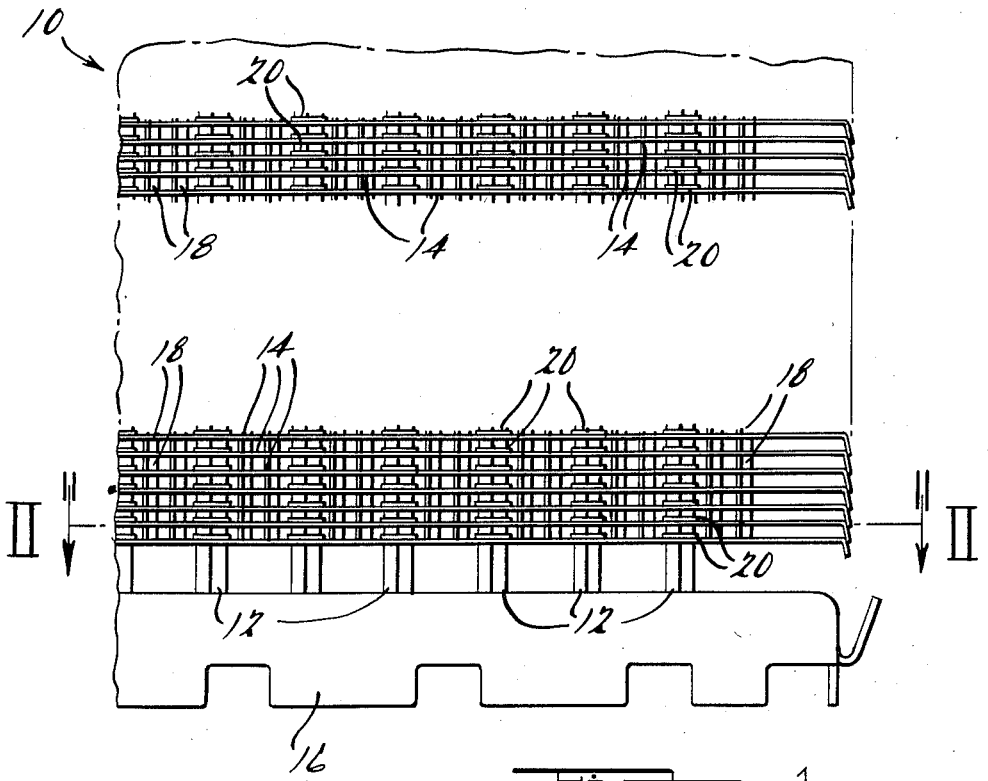
FIG. 1 is a partial elevation view of a mechanically assembled, elliptical tube, aluminum radiator which has tubes thereof attached to heat dissipating fins thereof in accordance with the method of this invention.

In FIG. 1, an elevation view is shown of a portion of a mechanically assembled, elliptical tube, aluminum radiator, generally defined by the numeral 10. This radiator has a plurality of elliptical tubes 12—12 mechanically assembled to a plurality of heat dissipating metal fins 14—14 in accordance with the teachings of the method of this invention. Respective ends of the tubes 12 are connected to headers 16, only one shown in FIGS. 1-2, which in turn can be connected to a plastic housing in order to define a container for liquid which is to flow through the fluid conducting tubes. The tubes 12 can be bonded to the headers 16 in the same manner as the tubes are bonded to the fins.

Figure 2:
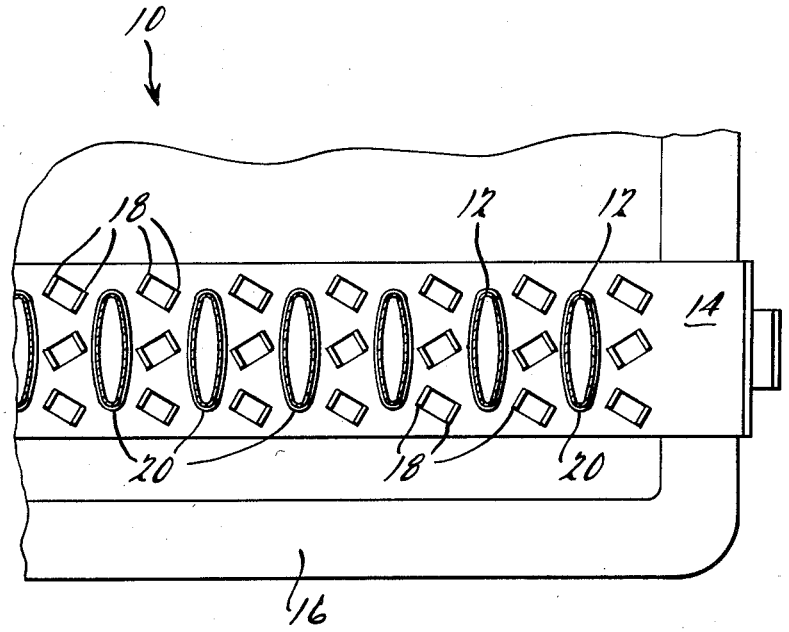
FIG. 2 is a plan view in cross-section taken along line II—II of FIG. 1.
Figure 1:
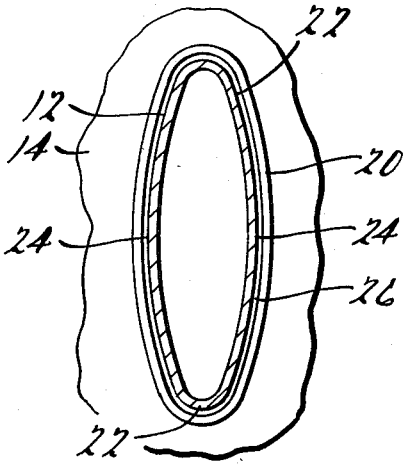
Figure 3:
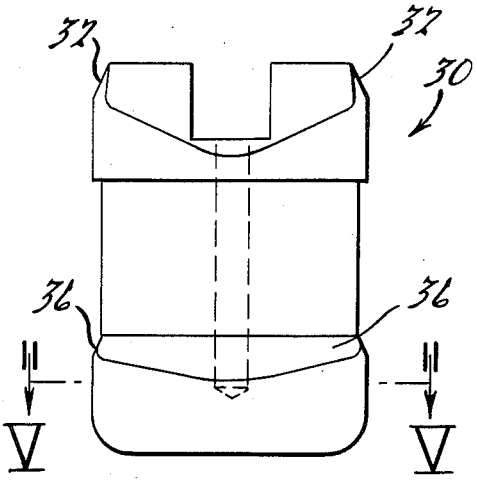
FIG. 3 is a front elevation view of a "bullet" used to expand the elliptical tube into contact with the fin in accordance with the teachings of the method of this invention.

As best seen in FIGS. 1-2, each fin 14 has a plurality of tabs 18—18 associated therewith. These tabs serve as spacers, as best shown in FIG. 1, to define fin pitch, that is, fin density, and to serve as air vanes to create better air flow to more critical heat transfer areas of the radiator 10. The tab can also provide a mixing potential for the air which allows the design of the radiator 10 to be optimized for thickness of fin and width of fin.

The fin also has associated therewith a plurality of elliptically shaped collars 20—20. The fin collars and tabs can be made by punching out these elements as the fin strip 14 is being made. The fin strip can be made from a hardened aluminum material such as AA-3003-H19 material.

In accordance with the teachings of the method of our invention, a fluid conducting metal tube 12 is attached to a heat dissipating metal fin 14 in the following manner. The attachment provides excellent mechanical support between the two elements and provides excellent physical contact therebetween for heat transfer purposes.

The metal tube 12 is formed from aluminum AA-3003-0 so as to have a generally elliptical cross-section. The easiest way to form the tube is to make a seamless, extruded, drawn and formed tube. The tube cross-sectional geometry is elliptical in nature. As seen only in FIG. 7, the metal tube has first similarly curved surfaces 22—22 at opposite ends of a major axis thereof and second similarly curved surfaces 24—24 at opposite ends of a minor axis thereof. In accordance with the teachings of our preferred embodiment, the ratio of the length of the major axis to the minor axis is 3.7:1. We generally prefer to have this ratio be at about 3:1 or higher to get the very best results from our process.

A heat dissipating metal fin 14 is formed. In accordance with the teachings of a preferred embodiment, the fin has associated therewith a plurality of tabs 18—18 and collars 20—20 which can be deformed from the fin surface using suitable dies, preferably stamping dies. Each of the collars 20—20, as originally formed, provide an opening through the fin 14. In the relatively thin fin material, these collars are at least about $1\frac{1}{2}$ times the thickness of the metal forming the fin. However, in the case of the heavier gauge metal used to form the header 16, there is no need of providing a collar in order to carry out the method of our invention.

As originally formed, each opening provided by the collar 20 of the fin 14 is of a size slightly larger than the elliptical cross-section of a corresponding tube 12. Therefore, as initially positioned, and as shown only in FIG. 7, there can be a slight space or opening 26 between a tube which has been placed inside the opening of the collar so that areas of the tube and the collar are juxtaposed, as shown in FIG. 7.

The process of our invention is carried out by utilization of a bullet, generally designated by the numeral 30, in FIGS. 3-6. The bullet 30 is forced through the tube 12 in order to expand the same into contact with one or more of the fins 14—14. In accordance with the teachings of the method of this invention, the bullet may be forced or pulled through the tube in either direction. However, we prefer to have the bullet moved through the tube in a direction opposed to the direction in which the collars 20—20 are facing from the fins 14—14. In the radiator 10, shown in FIG. 1, the preferred direction of movement of the bullet would be downwardly, as viewed in that direction. The reason for this direction of movement is that by directing the bullet in a direction opposing the upturned edge of the collar, the highest stress will be transmitted to the mating surfaces at right angles resulting in a tight, high contact joint.

In accordance with the teachings of the method of our invention, tube 12 is expanded along its major axis so as to bring the first similarly curved surfaces 22—22 therein at opposite ends thereof into contact with portions of the collar 20 in juxtaposition therewith. This first expansion is brought about by engagement of the tubes surface to be expanded by first engaging surfaces 32—32 of the bullet 30.

Figure 8:
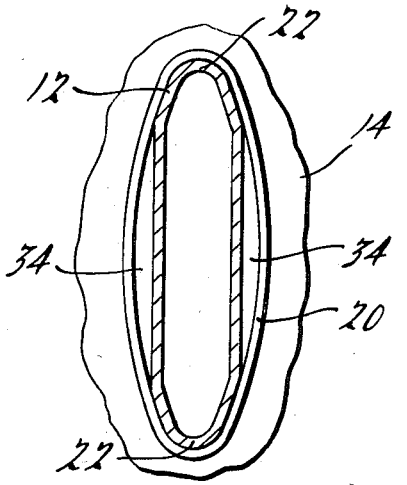
Figure 4:
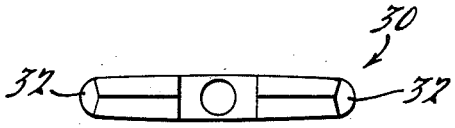
FIG. 4 is a plan view of the bullet of FIG. 3.
Figure 5:
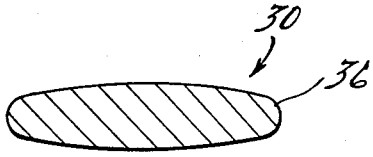
FIG. 5 is a cross-section view of the bullet of FIG. 3 taken along line V—V of that Figure.
Figure 9:
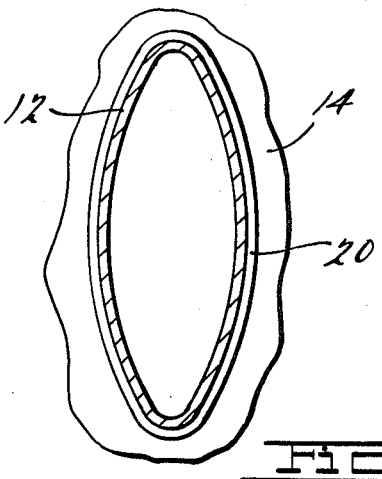
Figure 6:
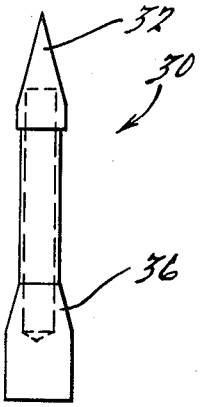
FIG. 6 is a side elevation view of the bullet of FIG. 3.

As best seen in FIG. 8, this first expansion of the tube 12 along its major axis causes the first similarly curved surfaces 22—22 to move into contact with portions of the collar 20 in juxtaposition therewith. This action also causes the generally elliptical shape of the tube to be changed into an oval shape, as shown in FIG. 8, in which spaces 34—34 are left between areas of the tube formerly at the opposite ends of the minor axis thereof and juxtaposed areas of the collar 20.

Second engaging surfaces 36—36 of the bullet 30 then engage the area of the tube 12 previously engaged by the first engaging surfaces 32—32 of the bullet. This engagement of the surface with the second engaging surfaces 36—36 continues expansion along the major axis of the elliptical cross-section tube and initiates expansion of the tube 12 from opposite ends of the major axis toward the surfaces 24—24 which were defined at opposite ends of the minor axis of the tube. In this manner, any juxtaposed area of the tube and the collar are subjected to an expansion process in which the tube is moved initially towards the collar, the two elements are then brought into contact with one another, and then the two elements are expanded together.

In accordance with the teachings of the method of our invention, the expansion process for the tube and collar is progressively terminated as that process moves from the major axis of the tube toward the minor axis thereof. The expansion process then is one which is not accomplished simultaneously about the entire perimeter of the tube at one location, but rather occurs progressively from each end of the major axis toward the minor axis of the elliptical tube at any given cross-section. The expansion process is terminated when juxtaposed areas of the tube and the collar reach a condition in which the tube is being deformed plastically, but the collar is still being deformed elastically. In this manner, since the tube is in a plastic deformation state, it remains in the deformed position. However, since the deformation of the collar is still elastic, the collar wants to return to its original position and applies force on the outside of the tube. In such a manner, an excellent mechanical contact is made between the deformed tube and collar, the mechanical contact also providing a contact which has excellent thermal conductivity properties. In this manner, an optimum fin/tube heat transfer interface is created. Generally, we desire approximately a 0.002–0.004 inch interference at the interface between the tube and the collar but the outerface can be as much as 0.012 inch or more.

While this specification has described the manner in which a single tube is bonded to a single collar of a single fin strip, it is, of course, readily apparent that the bullet 30 being moved through an individual tube will perform the same process along the length of the tube to bring each individual tube into bonding contact with the surrounding collar. In such a manner, a mechanically assembled, elliptical tube radiator construction can be formed.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of attaching a fluid conducting metal tube to a heat dissipating metal fin, which comprises the steps of:

forming a metal tube having a generally elliptical cross-section, said elliptical cross-section having first similarly curved surfaces at opposite ends of a major axis thereof and second similarly curved surfaces at opposite ends of a minor axis thereof;

forming a heat dissipating metal fin;

forming an ellipitcally shaped collar on said fin, said collar providing an opening through said fin and being at least about 1½ times the thickness of said metal forming said fin, said opening provided by said collar of said fin being of a size slightly larger than said elliptical cross-section of said tube;

fitting said tube inside said opening of said collar of said fin so that areas of said tube and said collar are juxtaposed;

expanding said tube along said major axis so as to bring said first similarly curved surfaces at opposite ends thereof into contact with portions of said collar in juxtaposition therewith;

continuing expansion along said major axis and initiating expansion of said tube from opposite ends of said major axis toward said surfaces which were defined at opposite ends of said minor axis of said tube so that any juxtaposed area of said tube and said collar are subjected to an expansion process in which said tube is moved towards said collar, said two elements are brought into contact with one another, and then said two elements are expanded together;

progressively terminating said tube and collar expansion process from said major axis of said tube toward said minor axis thereof as juxtaposed areas of said tube and said collar reach a condition in which said tube is being deformed plastically but said collar is still being deformed elastically.

2. The method of claim 1, in which said collar extends above one surface of said fin and wherein the deformation process takes place in a direction downwardly from the upstanding collar toward the fin.

3. The method of claim 1, wherein the ratio of the length of said major axis to said minor axis is 3:1 or higher.

4. The method of claim 1, wherein the ratio of the length of said major axis to said minor axis is 3.7:1.

5. A method of attaching a fluid conducting metal tube to a header member, which comprises the steps of:

forming a metal tube having a generally elliptical cross-section, said elliptical cross-section having first similarly curved surfaces at opposite ends of a major axis thereof and second similarly curved surfaces at opposite ends of a minor axis thereof;

forming a header member;

forming an ellipitcally shaped opening through said header member, said opening defining an elliptically shaped collar for said header member of a size slightly larger than said elliptical cross-section of said tube;

fitting said tube inside said opening of said collar of said header member so that areas of said tube and said collar are juxtaposed;

expanding said tube along said major axis so as to bring said first similarly curved surfaces at opposite ends thereof into contact with portions of said collar in juxtaposition therewith;

continuing expansion along said major axis and initiating expansion of said tube from opposite ends of said major axis toward said surfaces which were defined at opposite ends of said minor axis of said tube so that any juxtaposed area of said tube and said collar are subjected to an expansion process in which said tube is moved towards said collar, said two elements are brought into contact with one another, and then said two elements are expanded together;

progressively terminating said tube and collar expansion process from said major axis of said tube toward said minor axis thereof as juxtaposed areas of said tube and said collar reach a condition in which said tube is being deformed plastically but said collar is still being deformed elastically.

6. The method of claim 5, in which said collar extends above one surface of said fin and wherein the deformation process takes place in a direction downwardly from the upstanding collar toward the fin.

7. The method of claim 5, wherein the ratio of the length of said major axis to said minor axis is 3:1 or higher.

8. The method of claim 5, wherein the ratio of the length of said major axis to said minor axis is 3.7:1.

* * * * *